219-121 SR
6/16/81 XR 4,273,398

United States Patent [19]
Summers et al.

[11] 4,273,398
[45] Jun. 16, 1981

[54] METHOD AND APPARATUS FOR MANUFACTURING GAS-FILLED TUBES AND THE LIKE

[75] Inventors: Tommy L. Summers; David L. Yenawine, both of Richardson, Tex.

[73] Assignee: Texas Instruments Incorporated, Dallas, Tex.

[21] Appl. No.: 877,450

[22] Filed: Feb. 13, 1978

[51] Int. Cl.[3] ..... H01J 9/38; H01J 9/40
[52] U.S. Cl. ..... 316/20; 65/108; 65/112; 65/270; 219/121 LC; 219/121 LG
[58] Field of Search ..... 316/20, 17; 219/121 L, 219/121 LC, 121 LD, 121 LG, 121 LN, 121 LR; 65/108, 112, 113, 270

[56] References Cited

U.S. PATENT DOCUMENTS

| | | | |
|---|---|---|---|
| 3,628,846 | 12/1971 | Cortorillo | 316/19 |
| 3,943,324 | 3/1976 | Haggerty | 219/349 X |
| 4,044,936 | 8/1977 | Obersby | 219/121 LG |
| 4,045,201 | 8/1977 | Caffarella et al. | 65/105 |
| 4,082,392 | 4/1978 | Golin | 316/19 |
| 4,146,380 | 3/1979 | Caffarella et al. | 65/105 |

*Primary Examiner*—Richard B. Lazarus
*Attorney, Agent, or Firm*—Leo N. Heiting; Melvin S. Sharp; N. Rhys Merrett

[57] ABSTRACT

A unique method and apparatus for manufacturing gas-filled tubes utilizes an optically-spread beam of light to seal and cut short segments of tubing from a long tube containing the gas. Neither the laser beam nor the tubing is moved during the cutting and sealing operation. The gas being supplied to the length of tubing during the cutting and sealing operation is maintained at constant pressure so that each cut segment has the same resultant internal gas pressure. In one embodiment, radioactive light sources for illuminating displays and the like are manufactured by indexing a long phosphor-coated glass tube containing radioactive gas maintained at constant pressure, past a laser which generates an optically-spread light beam. The laser is activated in each index position of the tube to seal and cut short segments of the tubing with each segment having the same quantity of radioactive gas to provide the same desired quantity of illumination.

48 Claims, 7 Drawing Figures

Fig. 5
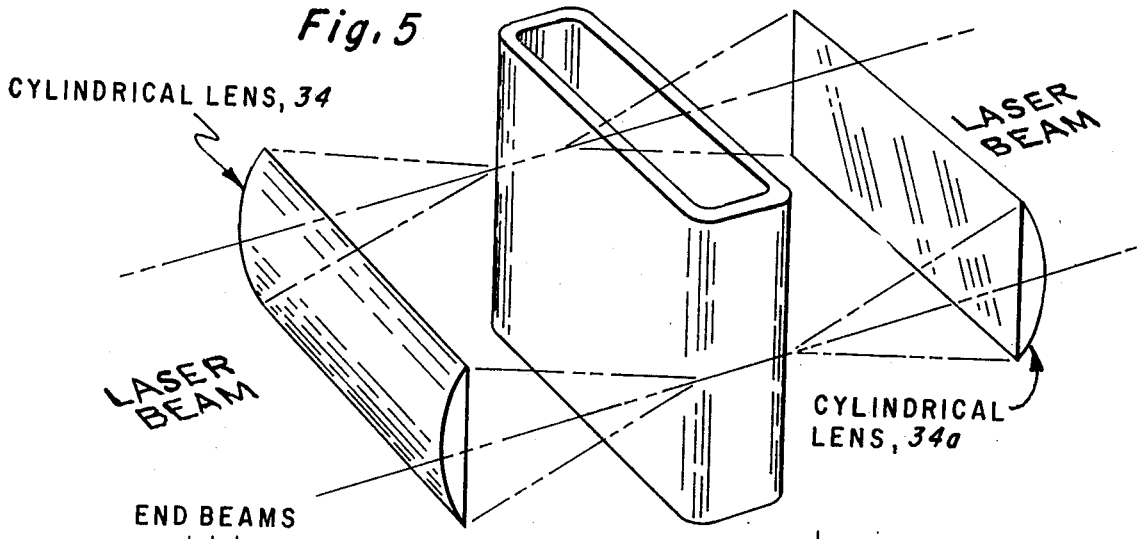
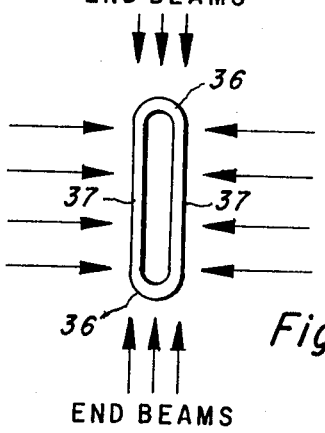
Fig. 7
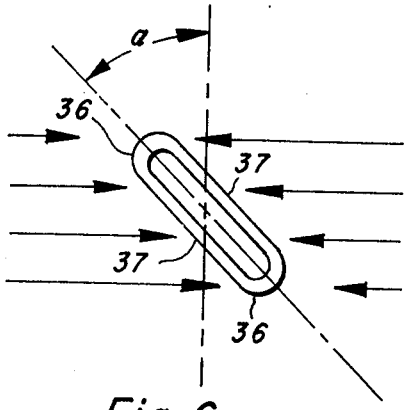
Fig. 6

METHOD AND APPARATUS FOR MANUFACTURING GAS-FILLED TUBES AND THE LIKE

BACKGROUND OF THE INVENTION

Phosphor-coated glass tubes containing radioactive beta particle-emitting gas, such as tritium gas, provide sources of illumination for displays and the like. Such devices have been utilized extensively, for providing backside illumination for liquid crystal displays in electronic timepieces and calculators.

Pin-point laser beam sources have been utilized in the manufacture of these devices to cut and seal tritium gas-filled tubes. In such manufacturing process, the tritium gas is put into long segments of glass tubing which are then sealed at both ends before the laser sealing and cutting of the tube into shorter segments. This method requires relative movement between the laser beam and tubing. In one system, the laser beam is moved by means of a galvanometer optical system or other system across the glass tubing. In another system, a mechanical system moves the tubing past a fixed laser beam to seal and cut segments from the tubing. These prior art methods have several disadvantages: the galvinometer system which moves and positions the beam is relatively expensive and usually requires the use of a programmable mini-computer. The mechanization required to move the tube past a fixed laser beam is likewise an intricate process requiring relatively expensive and complex equipment and speed control. Furthermore, the process of filling a long segment of glass tubing with tritium gas and sealing both ends prior to sealing and cutting the tubing into smaller segments results in a great variance in the pressure of the gas contained in the cut segments; hence, the brightness is not consistent in the resulting light sources.

It is therefore an object of the present invention to provide an improved method of cutting and sealing gas-filled tubing.

Another object of the invention is to provide an improved method of manufacturing radioactive light sources for illuminating displays and the like.

A further object of the invention is to provide a method of laser beam cutting and sealing gas-filled tubing without the necessity of relative movement between the beam and tubing.

Still another object of the invention is to provide a method for manufacturing radioactive light sources for displays and the like with consistent brightness from each source.

It is another object of the invention to provide an improved apparatus for cutting and sealing gas-filled tubing.

Still another object of the invention is to provide an improved apparatus for the manufacture of radioactive light sources.

It is a further object of the invention to provide a laser beam system for cutting and sealing gas-filled tubing without relative movement between the beam and the tubing.

Yet another object of the invention is to provide an apparatus for manufacturing improved radioactive light sources.

It is still another object of the invention to provide an apparatus for manufacturing radioactive light sources with consistent brightness.

BRIEF SUMMARY OF THE INVENTION

These and other objects are accomplished in accordance with the present invention in which a method and apparatus for manufacturing gas-filled tubes utilizes an optically-spread beam of light to seal and cut short segments of tubing from a long tube containing the gas. Neither the laser beam nor the tubing is moved during the cutting and sealing operation. The gas being supplied to the length of tubing during the cutting and sealing operation is maintained at constant pressure so that each cut segment has the same resultant internal gas pressure. In one embodiment, radioactive light sources for illuminating displays and the like are manufactured.

Glass tubing with rectangular or eliptical cross section has its interior coated with a phosphor material. One end of the tube is sealed, while the other end is connected to a source of a phosphor-activating radioactive gas such as tritium gas. The gas source is regulated to maintain a desired level of constant pressure in the tube so that each small sealed segment, which is cut from the tube, will have the same desired pressure and thereby provide the same quantity of illumination. A manifold, holding the glass tube, pressurized with regulated tritium, is indexed down past windows located in each side of a chamber. At each index position, the laser is fired through the windows to seal and cut segments of the tubing at the desired length. Neither the laser beam nor the glass tubing is moved during the cutting and sealing operation. Instead, the laser beam is optically spread from a round, cylindrical column of light to a line or wedge shape of light. As each sealing and cutting operation is completed, a short segment of the tube becomes detached. The chamber is designed so that there is a pressure differential between the inside and the outside of the tube with the outside pressure being higher than the inside pressure to aid in forming the glass seal.

BRIEF DESCRIPTION OF THE DRAWINGS

Still further objects and advantages of the invention will be apparent from the detailed description and claims and from the accompanying drawings, in which:

FIG. 5 is a perspective view representing a lens arrangement for providing a linear beam of light energy in accordance with the present invention; and FIGS. 6 and 7 are system diagrams of alternate embodiments utilized for providing additional heat to thick walls at the narrow edges of relatively flat-shaped tubing, if required.

DETAILED DESCRIPTION OF THE PREFERRED EMBODIMENTS

Referring then to the drawings, a unique system for manufacturing sealed gas-filled tubes is illustrated. The system employs lens systems to focus light energy, such as that generated by a $CO_2$ laser, to a relatively thin line rather than a circular spot. The focused light energy, controlled, for example, by a shutter, melts, seals and cuts the tube at its focal point. A distinctive feature of the system is that neither the laser beam nor the tube moves or rotates during the cutting operation.

Figure 1:
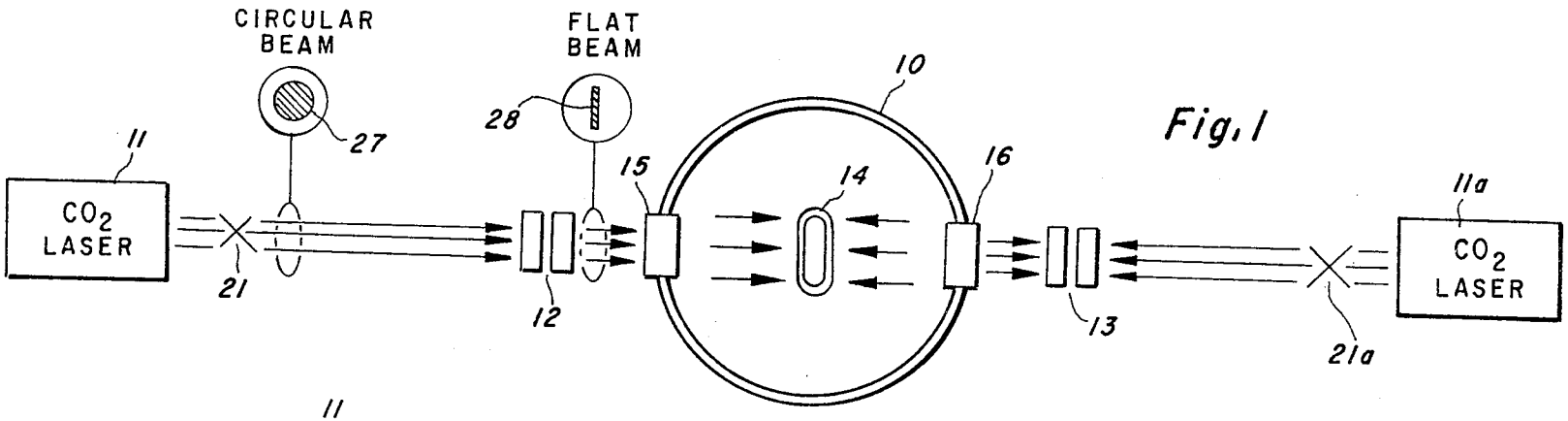
FIG. 1 is a block diagram of a multi-laser beam system embodying the present invention.

Referring then to FIG. 1, a multi-light energy source system, embodying the present invention, is shown. In this system, a sealed pressure chamber 10 is provided for containing tubes 14 to be cut. Tube 14 comprised, for example, of glass such as borosilicate glass, is mounted in chamber 10. Two $CO_2$ laser beam generators 11 and 11*a* of a selected wave length, which is absorbed by the glass, are provided on opposite sides of chamber 10. The generally circular beams (ie 27) provided by $CO_2$ laser beam generators 11 and 11*a*, are focused through lens systems 12 and 13, respectively, which are arranged to change the circular beams to relatively flat linear beams (ie 28). The relatively flat beams pass through windows 15 and 16 of pressure chamber 10 and cut across the entire cross section of glass tubing 14 at the focal point of the lens system. The beams are focused onto tube 14 for a predetermined time period as controlled by shutter members 21 and 21*a*.

Figure 2:
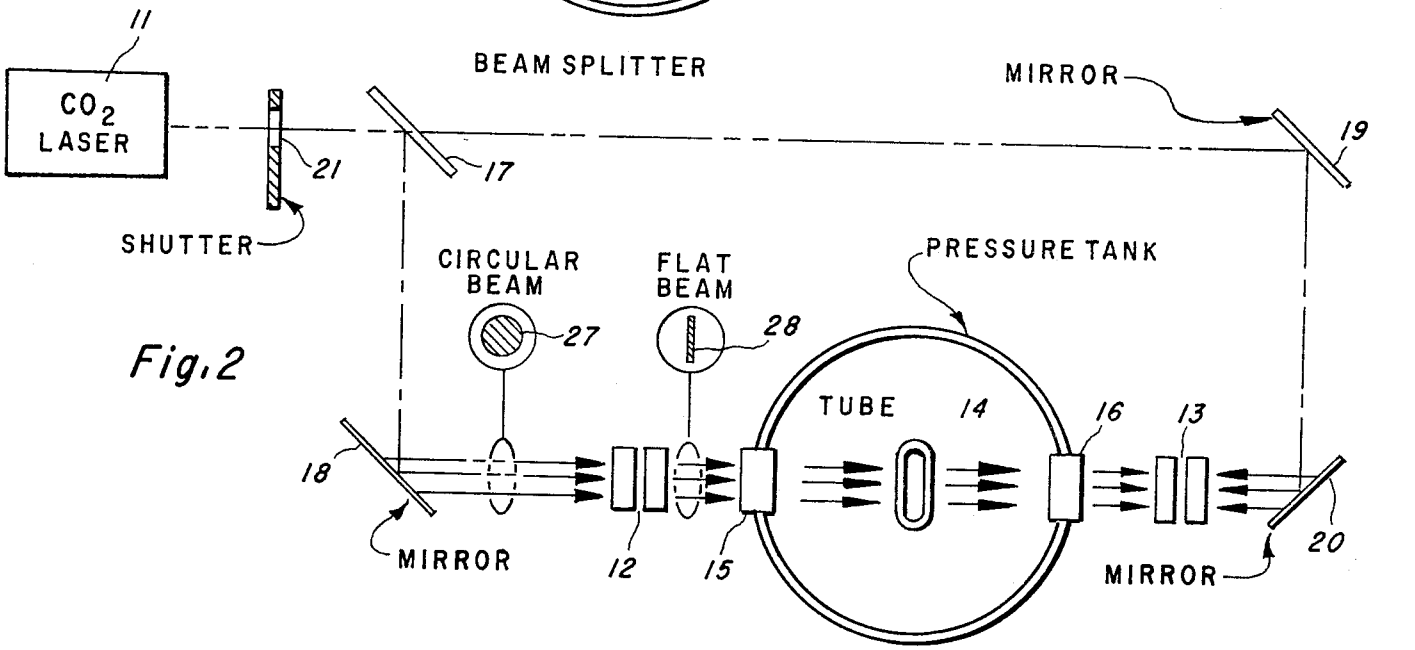
FIG. 2 is a block diagram of a single laser beam system embodying the present invention.

Another system embodying the present invention is the single light energy source system illustrated in FIG. 2. In this embodiment, the generally circular beam generated by a single $CO_2$ laser beam generator 11 is split by at least one beam splitter 17 into at least two separate beams which are reflected by mirror 18 and mirrors 19 and 20, respectively. Mirrors 18 and 20, which are located on opposite sides of pressure chamber 10, reflect the generally circular beams (ie 27) which are then focused through lens systems 12 and 13 to provide the relatively linear beams (ie 28) which pass through chamber windows 15 and 16 to cut the tube 14 at the lens' focal point. The beam is focused onto tube 14 for a predetermined time period as controlled by shutter member 21.

Figure 3:
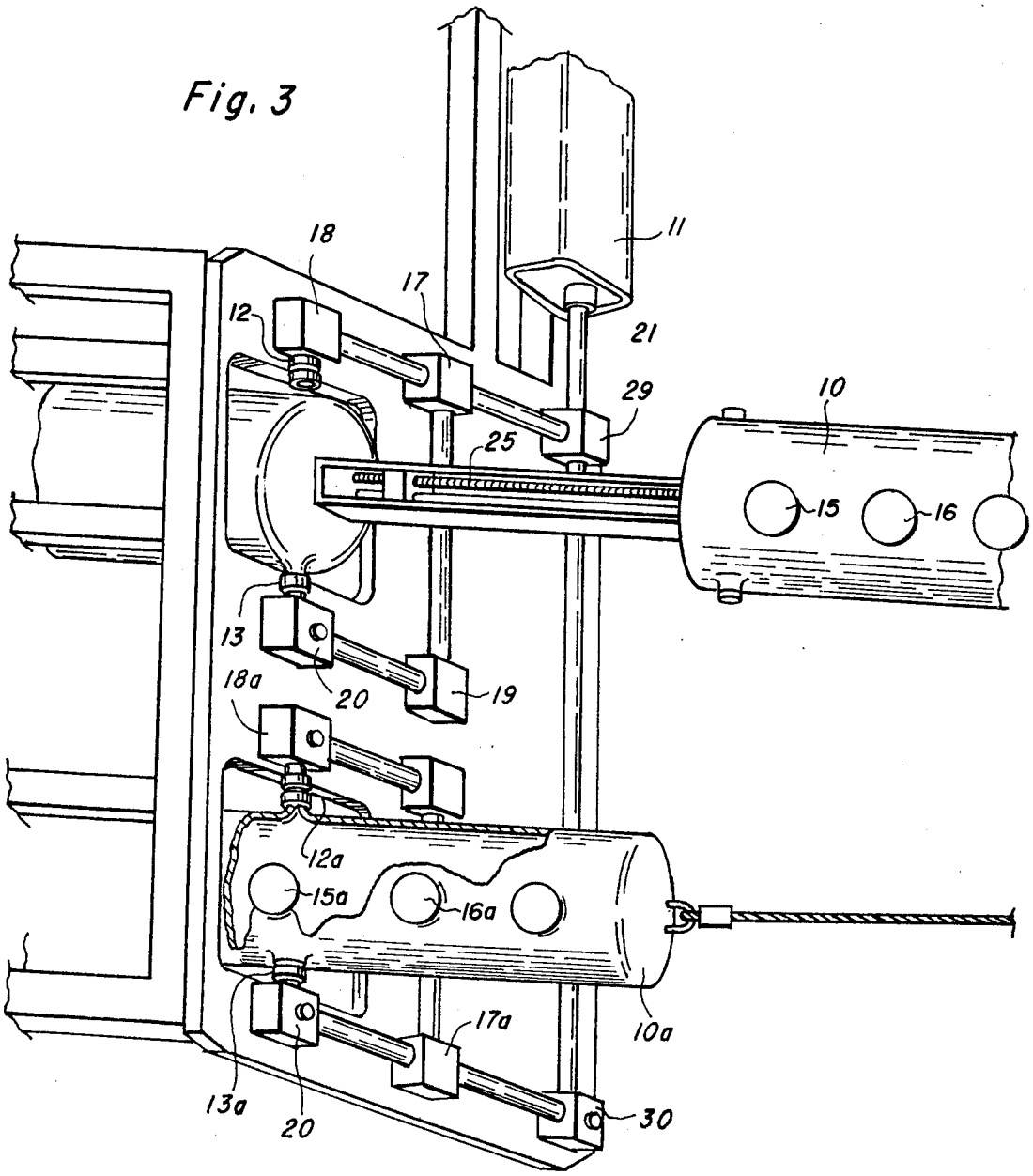
FIG. 3 is a perspective view of an apparatus for accomplishing the system of FIG. 2.

Referring to FIG. 3, an apparatus accomplishing one embodiment of the system of FIG. 2 is illustrated in detail.

In the system of FIG. 3, two pressure chambers 10 and 10*a* are provided, both receiving light energy from single $CO_2$ laser 11. Beam splitter 29 and mirror 30 provide separate beams to beam splitters 17 and 17*a* which, in turn, provide pairs of laser light beams to respective pressure chambers 10 and 10*a*. The two beams provided by beam splitter 17 are reflected to lens systems 12 and 13 by means of mirror 18 and mirrors 19 and 20, respectively; the two beams provided by beam splitter 17*a* are reflected to lens systems 12*a* and 13*a* by means of mirror 18*a* and mirrors 19*a* and 20*a*, respectively.

Figure 4:
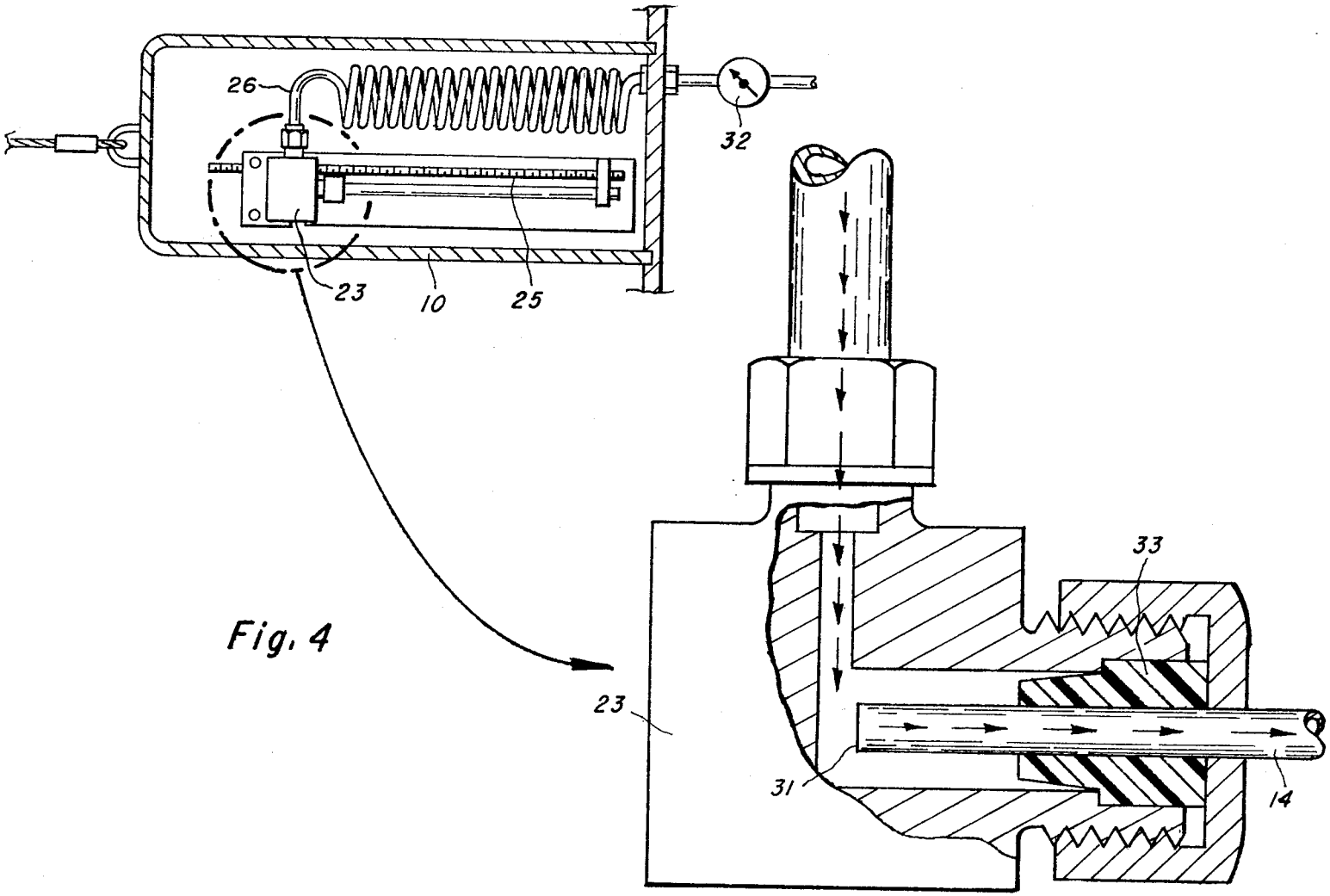
FIG. 4 is a cut-away view of a pressure tank utilized in the apparatus of FIG. 3 with the means for maintaining constant gas pressure illustrated in particular detail.

Referring to FIG. 4, in operation, long tubes (ie 14), having one sealed end, are placed in the chambers (ie 10). The chambers are then sealed and pressurized. The open ends 31 of the tubes 14 are coupled, by means of stopper 33, to a fluid supply 32, the fluid generally being in a gaseous state, which fills the tube with the fluid by means of valve block positioner 23 and conduit 26. The fluid is maintained by source 32 at constant predetermined pressure so that each segment, which is sealed and removed from the parent tube, contains such fluid at such predetermined pressure.

Referring once again to FIG. 3, the tubes (ie 14) are indexed in predetermined increments past laser windows 15 and 16 of chamber 10, and 15*a* and 16*a* of chamber 10*a*, respectively, by means of worm gears (ie 25). Each time that the tubes are in position, shutter 21 is opened and closed allowing the laser beam to be focused on the tubes by means of lens systems 12 and 13 and lens systems 12*a* and 13*a*, thereby sealing and severing sections of such predetermined incremental length from the tubes.

In one example, tritium light sources for backlighting digital displays are manufactured utilizing the above-described apparatus. In such manufacturing process, borosilicate (eg, Pyrex) or quartz glass tubes having an interior surface coated with a phosphor material (eg, Sylvania P-22 ZnS) are sealed at one end. The glass tubes have, for example, rectangular or oval cross-sections approximately 0.2" wide at the major axis and 0.030" wide at the minor axis, and have a nominal wall thickness of approximately 0.009". The tubes are placed in the pressure chamber with the open ends being coupled to the tritium gas source, and the pressure chamber is sealed. The pressure chamber is then pressurized to a level of approximately 3 atm.. The tubes are evacuated, then filled with tritium gas which is maintained at a constant 2-atm. pressure.

The tubes are then separately or simultaneously indexed to first positions at which control shutter 12 is opened for a predetermined time period (eg, 0.5 sec. to 5 sec.) depending upon power levels and glass composition and thickness. Gas-filled segments, approximately 0.7" in length, are thereby sealed and severed from the parent tubes. The $CO_2$ laser has a power rating sufficient to melt the glass (ie, 40–100 watts for Pyrex glass of the above dimensions) and a wave length which is absorbed by the glass ($CO_2$ for Pyrex). The beam is focused at the desired indexed position to a thickness preferably of 0.050" or less. The width of the relatively thin linear beam is preferably greater than the tube width (ie, greater than 0.2") so that the entire tube is sealed and cut in a single burst of the laser beam without moving either the tube or the beam. The lens system distributes the power level from the edges of the beam to the center of the beam so that the edges of the tube get as much or more power than the center of the tube. The severed sections of the tubes fall off into containers (not shown) located at the chamber bottoms. In other embodiments, mechanical means, such as an arm, may be employed to grab the sections prior to or after the severing has occurred and remove them to a receptacle.

The above process is repeated until the entire tubes have been cut into backlight sections of desired length. The tritium gas remaining in the tube stubs is withdrawn; the pressure chambers are evacuated to remove any residual tritium, then backfilled with inert gas to about 1 atm. and opened. The tubes stubs are removed and new tubes placed in the valve block positioner of each chamber. The process is then repeated.

One lens system employed in an embodiment of the present invention is represented in the perspective FIG. 5. Each lens system (12, 13 of FIGS. 1 or 2) is comprised of a cylindrical lens 34, 34*a* which transforms the circular beam 27 into a relatively narrow, flat beam 28. Cylindrical lenses of this type are well known in the art.

An alternate, method of producing a linear beam, which is not illustrated herein, involves splitting each cylindrical beam into two separate beams which are separately focused by means of ordinary lenses onto the tube, a small portion of each beam being superimposed on the other, thereby reinforcing each other along the superimposed portion to form a narrow linear beam suitable for cutting and sealing the tubing.

For tubing having a much greater wall thickness at the ends, appropriate modification to the systems of FIG. 1 or FIG. 2 may be made to compensate for this additional thickness. One technique for accomplishing the cutting and sealing of this particular type of tubing is illustrated in FIG. 6. The tubing 14 is positioned at a predetermined angle $\alpha$ from the normal position, illustrated in FIGS. 1 and 2, with the lens systems being focused at the thicker ends 36 thereby concentrating a greater amount of energy at the thicker ends 36 than along the thinner walls 37.

Another technique for accomplishing this is illustrated in FIG. 7. In this embodiment, additional end beams 35 provide sufficient light energy directly focused at ends 36. The additional beams may be provided by utilizing separate lasers or by utilizing beam splitters to sub-divide the beams being focused along the major axis.

Various embodiments of the method and apparatus for manufacturing gas-filled tubes and the like according to the present invention have now been described in detail. Since it is obvious that many changes and modifications can be made in the above details without departing from the nature and spirit of the invention, it is understood that the invention is not to be limited to said details except as set forth in the appended claims.

What is claimed is:

1. A method of simultaneously cutting and sealing a length of tubing having a predetermined width comprising the step of focusing a relatively long and narrow beam of light energy simultaneously across the entire width of said tube to thereby sever and seal said tube along said width, the length of said beam being at least equal to the width of said tube.

2. The method according to claim 1 wherein said light energy is focused through a cylindrical lens to provide said relatively narrow beam of light energy.

3. The method according to claim 1 wherein said light energy is provided by a laser.

4. The method of simultaneously sealing and severing segments of tubing of predetermined length from relatively long parent tubes comprising the steps of continually indexing a parent tube in increments said predetermined length and focusing a relatively long and narrow beam of light energy simultaneously across the entire width of said parent tube at each indexed position.

5. The method according to claim 4 including the steps of: filling said parent tube with a fluid from one end thereof and maintaining the fluid in said parent tube at a constant predetermined pressure whereby each of the severed segments of tubing contains said fluid at said predetermined pressure.

6. The method according to claim 5 wherein said fluid is a gas.

7. The method according to claim 4 wherein said light energy is focused through a cylindrical lens to provide said relatively long and narrow beam.

8. The method according to claim 4 wherein said light energy is generated by a laser.

9. A method of simultaneously severing and sealing fluid-filled segments of tubing of predetermined length from relatively long parent tube comprising the steps of:

(a) sealing one end of the parent tube;
(b) mounting said parent tube in a pressure chamber;
(c) maintaining said pressure chamber at a first predetermined pressure;
(d) filling said parent tube with said fluid via the unsealed end thereof;
(e) maintaining the fluid in said parent tube at a constant second predetermined pressure whereby each of the severed and sealed segments of tubing contains said fluid at said predetermined pressure;
(f) indexing said parent tube in increments of said predetermined length;
(g) focusing a relatively long and narrow beam of light energy simultaneously across the entire width of said parent tube at each indexed position to thereby seal and sever said tube along said width, the length of said beam being at least equal to the width of said tube; and
(h) removing the fluid-filled segments from said pressure chamber.

10. The method according to claim 9 including the steps of: evacuating any remaining fluid from any remaining portion of said parent tube, depressurizing said pressure chamber and removing the remaining portion of said parent tube.

11. The method according to claim 9 wherein said tubing is comprised of glass.

12. The method according to claim 11 wherein said glass is a borosilicate material.

13. The method according to claim 12 wherein a $CO_2$ laser beam is focused through a cylindrical lens to provide said relatively long and narrow beam to cut said borosilicate material.

14. The method according to claim 9 wherein light energy is focused through a cylindrical lens to provide said relatively long and narrow beam.

15. The method according to claim 9 wherein said light energy is generated by a laser.

16. The method according to claim 9 wherein said fluid is a gas.

17. The method according to claim 16 wherein said gas is a source of radioactive energy.

18. The method according to claim 17 wherein said gas is comprised of tritium.

19. The method according to claim 16 including the step of coating the interior surface of said parent tube with phosphorous prior to placing said parent tube in said pressure chamber.

20. A method of manufacturing radioactive gas-filled light sources for illuminating displays and the like comprising the steps of:

(a) coating the interior surface of a glass tube with a phosphor material;
(b) sealing one end of said glass tube;
(c) mounting said glass tube in a pressure chamber;
(d) maintaining said pressure chamber at a first predetermined pressure;
(e) filling said glass tube with a radioactive gas via the unsealed end thereof, said radioactive gas for generating energy to excite said phosphor material and thereby produce light energy;
(f) maintaining said radioactive gas in said glass tube at a constant second predetermined pressure whereby each gas-filled light source contains said radioactive gas at said predetermined pressure;
(g) indexing said glass tube in increments of a predetermined length;
(h) focusing a laser beam through a cylindrical lens to provide a relatively long and narrow beam of light energy simultaneously across the entire width of said glass tube at each indexed position to thereby seal and sever said tube along said beam, the length of said beam being at least equal to the width of said tube; and (i) removing gas-filled segments of said predetermined length from said pressure chamber.

21. The method according to claim 20 including the steps of:

(a) evacuating any remaining radioactive gas from any remaining portion of said glass tube;

(b) depressurizing said pressure chamber; and (c) removing the remaining portion of said glass tube.

22. The method according to claim 20 wherein said glass is a borosilicate glass and said laser beam is generated by a $CO_2$ laser.

23. The method according to claim 20 wherein said glass tube has a substantially rectangular cross section, the laser beam being focused across a major side of said rectangular cross-section.

24. The method according to claim 20 wherein said parent tube has a substantially oval cross-section and the laser beam is focused across a major axis of said oval cross-section.

25. The method according to claim 20 wherein said gas is comprised of tritium.

26. The method according to claim 20 wherein said laser beam is focused through cylindrical lenses mounted on opposite sides of said glass tube to provide greater light energy for sealing and severing said tube.

27. An apparatus for cutting and sealing tubing comprised of:

(a) mounting means for mounting a length of tubing; and (b) stationary means for focusing a relatively long and narrow beam of light energy simultaneously across the entire width of said tubing to cut and seal said tubing along said beam.

28. The apparatus according to claim 27 including a laser beam generator for producing said beam of light energy and a lens system for converting the generated laser beam to a relatively long and narrow beam and for focusing said long and narrow beam on said tube.

29. The apparatus according to claim 28 wherein said lens system is comprised of a cylindrical lens.

30. An apparatus for sealing and severing sections of gas-filled tubing comprising:

(a) mounting means for mounting a parent tube, said parent tube having one sealed end;

(b) indexing means coupled to said mounting means for continually indexing said parent tube in increments of a predetermined length; and (c) stationary means for focusing a relatively long and narrow beam of light energy simultaneously across the entire width of said parent tube at each indexed position thereof.

31. The apparatus according to claim 30 including means for filling said parent tube with a fluid from the unsealed end thereof and for maintaining said fluid at a constant predetermined pressure in said parent tube whereby each of the severed sealed segments of tubing contains said fluid at said predetermined pressure.

32. The apparatus according to claim 31 wherein the fluid is a gas.

33. The apparatus according to claim 30 wherein said indexing means is comprised of a worm gear coupled to said mounting means for moving said mounting means laterally along said worm gear and means for rotating said worm gear to provide incremental movement of said predetermined length to said mounting means.

34. An apparatus for manufacturing fluid-filled segments of glass tubing comprising:

(a) a pressure chamber;

(b) mounting means located in said pressure chamber for mounting glass tubes thereon, said glass tubes having one sealed end;

(c) means in fluid communication with said pressure chamber for maintaining said pressure chamber at a first predetermined pressure;

(d) means coupleable to the unsealed end of a glass tube for filling said glass tube with said fluid via said unsealed end and for maintaining said fluid in said tube at a constant second predetermined pressure whereby each fluid-filled segment severed from said glass tube contains said fluid at said predetermined pressure;

(e) indexing means coupled to said mounting means for indexing a mounted glass tube in increments of said predetermined length;

(f) stationary means for focusing a beam of light energy on said tubing, said stationary means for generating and focusing a relatively long and narrow beam of light energy simultaneously across the entire width of said glass tube; and (g) control means synchronized with said indexing means for controlling said beam wherein said beam is focused on said glass tube at each indexed position thereof to seal and sever along said beam.

35. The apparatus according to claim 34 wherein said glass tubes have the interior surface thereof coated with a phosphor material and wherein said fluid is comprised of a radioactive gas for generating radioactive energy to excite said phosphor material and thereby produce light energy.

36. The apparatus according to claim 34 wherein a pair of light beams is focused through a pair of lenses mounted on opposite sides of side glass tube to provide more uniform distribution of light energy around said tube for sealing and severing said tube.

37. The apparatus according to claim 36 wherein said glass tubes have an essentially rectangular cross-section with major sides forming the width of said tube and relatively narrow ends and wherein said tube is mounted in said mounting means with the major sides perpendicular to said light beams.

38. The apparatus according to claim 37 wherein said narrow ends have greater wall thicknesses than said major sides and wherein an additional pair of light beams perpendicular to said first pair is focused along the ends of said tubes to provide greater light energy to sever said ends.

39. The apparatus according to claim 36 wherein said glass tubes have an essentially oval cross-section with a major axis forming the width of said tube and a minor axis and wherein said tubes are mounted in said mounting means with the major axis perpendicular to said light beam.

40. The apparatus according to claim 39 wherein at least one additional pair of light beams perpendicular to said first pair is focused on the ends of said oval tubes.

41. The apparatus according to claim 36 wherein said glass tubes have an essentially rectangular cross-section with major sides forming the width of said tube and relatively narrow ends and wherein said tubes are mounted in said mounting means such that the major sides are non-perpendicular with respect to said light beam.

42. The apparatus according to claim 36 wherein said glass tubes have an essentially oval cross-section with a major axis forming the width of said tube and a minor axis and wherein said tubes are mounted in said mounting means such that the major axis is non-perpendicular with respect to said light beam.

43. The apparatus according to claim 34 wherein said stationary means is comprised of a laser beam and at least one lens member for focusing said laser beam on said glass tube.

44. The apparatus according to claim 43 wherein said lens member is comprised of at least one cylindrical lens for converting a laser beam of essentially circular cross-section to a laser beam of relatively long and narrow essentially rectangular cross-section.

45. The apparatus according to claim 34 wherein said indexing means is comprised of a worm gear coupled to said mounting means for moving said mounting means laterally along said worm gear and means for rotating said worm gear to provide incremental movement of said predetermined length to said mounting means and the tube mounted thereon.

46. An apparatus for manufacturing light sources for illuminating displays and the like comprising:

(a) a pressure chamber;

(b) mounting means located in said pressure chamber for mounting glass tubes thereon, said glass tubes having the interior surface thereof coated with a phosphor material and one sealed end;

(c) means in fluid communication with said pressure chamber for maintaining said pressure chamber at a first predetermined pressure;

(d) means coupleable to the unsealed end of a glass tube for filling said glass tube with a radioactive gas via said unsealed end and for maintaining said radioactive gas in said tube at a constant second predetermined pressure whereby each gas-filled segment severed from said glass tube contains said radioactive gas at said predetermined pressure;

(e) indexing means coupled to said mounting means for indexing each mounted glass tube in increments of a predetermined length;

(f) stationary means for focusing laser light beams on said tubing, said stationary means including means for generating a plurality of laser light beams and lens means mounted on opposite sides of said tubing for converting said laser light beams to relatively long and narrow beams of laser light energy and for focusing said relatively long and narrow beam simultaneously across the entire width of said glass tube on opposite sides thereof; and (g) control means synchronized with said indexing means for controlling said laser light beams wherein said beams are focused on said glass tube at each indexed position thereof to seal and sever said tube along said beam and to provide said light sources.

47. The apparatus according to claim 46 wherein said gas is comprised of tritium.

48. The apparatus according to claim 46 wherein said glass is comprised of a borosilicate material.

* * * * *